US006842404B2

(12) United States Patent
Haselberger

(10) Patent No.: US 6,842,404 B2
(45) Date of Patent: Jan. 11, 2005

(54) DISPLAY DEVICE FOR WATCHES

(75) Inventor: Walter Haselberger, Javea (ES)

(73) Assignee: Cartier International, B.V. (NL)

( * ) Notice: Subject to any disclaimer, the term of this patent is extended or adjusted under 35 U.S.C. 154(b) by 0 days.

(21) Appl. No.: 10/398,148

(22) PCT Filed: Oct. 11, 2001

(86) PCT No.: PCT/EP01/11798

§ 371 (c)(1),
(2), (4) Date: Aug. 25, 2003

(87) PCT Pub. No.: WO02/31603

PCT Pub. Date: Apr. 18, 2002

(65) Prior Publication Data

US 2004/0027926 A1 Feb. 12, 2004

(30) Foreign Application Priority Data

Oct. 12, 2000 (DE) ..... 100 50 557

(51) Int. Cl.[7] ..... G04B 19/00
(52) U.S. Cl. ..... 368/223; 368/77
(58) Field of Search ..... 368/21–27, 34–40, 368/15–20, 62–70, 76–80, 223–242

(56) References Cited

U.S. PATENT DOCUMENTS

| | | | | | |
|---|---|---|---|---|---|
| 508,467 | A | * | 11/1893 | Clark | 368/18 |
| 1,997,511 | A | * | 4/1935 | Canepa | 368/18 |
| 3,721,083 | A | * | 3/1973 | Jauch | 368/18 |
| 4,548,512 | A | * | 10/1985 | Erard | 368/15 |
| 4,684,260 | A | * | 8/1987 | Jackle | 368/16 |
| 4,740,934 | A | | 4/1988 | Noirjean | |
| 4,759,002 | A | * | 7/1988 | Cash | 368/15 |
| 5,023,849 | A | * | 6/1991 | Vaucher | 368/15 |
| 6,359,839 | B1 | * | 3/2002 | Schenk et al. | 368/16 |
| 6,507,536 | B1 | * | 1/2003 | Keatch | 368/16 |

FOREIGN PATENT DOCUMENTS

| | | | | |
|---|---|---|---|---|
| CH | 664468 A3 | * | 12/1978 | 368/21 |
| CH | 671317 A3 | * | 12/1978 | 368/15 |
| DE | 738 177 C | | 7/1943 | |
| DE | 74 41 446 U | | 6/1973 | |

OTHER PUBLICATIONS

Uhrenmagazin 7/8 96, Jun. 26, 1996, p. 39.

Armbanduhren 2 96, Jun. 5, 1996, 2 pages.

Chronos 4 96, Jun. 21, 1996, 2 pages.

Armbanduhren 3/97, p. 42.

Uhrenmagazin 4/96, Apr., 1996, p. 105.

* cited by examiner

*Primary Examiner*—Kamand Cuneo
*Assistant Examiner*—Thanh S. Phan
(74) *Attorney, Agent, or Firm*—Baker & Daniels

(57) ABSTRACT

A display device for watches, comprising a watch dial provided with a day hours display window for displaying a respective one of the hours of the day during daytime and with a separate night hours display window for displaying a respective one of the hours of the night during nighttime. The display device for watches comprises a day hours disc provided with twelve hour numbers and a night hours disc provided with twelve hour numbers. The two hour display windows and the two hour discs are arranged such that the hour numbers of the day hours disc are visible only in the day hours display window, and the hour numbers of the night hours disc are visible only in the night hours display window. By using two separate hour discs and two separate hour display windows for displaying the day hours and for displaying the night hours, respectively, hour number representations on the one hand can be larger than when using a single hour display window and a single 24-hour disc. On the other hand, it is possible with two separate hour discs and with two separate hour display windows to use only the hour numbers 1 to 12 for each hour disc. The number of two-digit figures requiring a relatively large amount of space is greatly reduced, and the hour numbers 20 to 24 beginning with the number 2, taking up particularly much space, are not required.

11 Claims, 15 Drawing Sheets

DISPLAY DEVICE FOR WATCHES

BACKGROUND OF THE INVENTION

The invention relates to a display device for watches, for example wristwatches or pocket watches.

There are wristwatches having a 24-hour display, the dial thereof being provided with an hour display window displaying one of 24 hour numbers for one hour each, said hour numbers being provided on an hour disc arranged underneath the dial and so as to be rotatable relative to the hours display window. As the hour disc has to accommodate 24 hour numbers, with the hour numbers 20 and 24 taking up particularly much space due to their 2 at the beginning, the display window and the particular hour number visible therein have to be relatively small especially in case of wristwatches of smaller dimensions, thus aggravating the readability thereof. Representations of such a wristwatch can be found in the following special publications: Uhrenmagazin 7/8 96, Jun. 26, 1996, page 39; Armbanduhren 2 96, Jun. 5, 1996; and Chronos 4 96, Jun. 21, 1996.

In addition thereto there are wristwatches having two semicircular arcs arranged on a watch dial concentrically with respect to each other and radially spaced apart, each being provided with twelve hour numbers, one of the two semicircular arcs indicating 12 day hours and the other semicircular arc indicating 12 night hours. These two semicircular arcs have a two-arm hour hand associated therewith which carries out one revolution every 24 hours and the axis of rotation of which is concentric with the two semicircular arcs and the two arms of which are of different lengths, such that during one half of a 24-hour period the longer hand arm points to the hour numbers of the outer one of the two semicircular arcs and during the other half of a 24-hour period the shorter hand arm points to the hour numbers of the inner one of the two semicircular arcs. The two semicircular arcs take considerable space of the watch dial surface which sometimes may be undesirable for reasons of design or in case of watches the dial of which, in addition to various time displays, such as hour, minute and second displays, is to accommodate still further kinds of display, such as a date display and/or a moon phase display. Representations of such a wristwatch are contained in ARMBANDUHREN 3/97, page 42, and in Uhren Magazin 4/96, page 105.

The present invention is to overcome such disadvantages. In particular, a display device for watches is to be provided having a 24-hour display, which with little consumption of space on the wrist dial surface, renders possible good readability of the particular hour.

This is achieved by a display device for watches according to the invention, comprising a watch dial provided with a day hours display window for respectively displaying one of the hours of the day during daytime and a separate night hours display window for respectively displaying one of the hours of the night during nighttime, a day hours disc provided with twelve hour numbers and adapted to be rotationally advanced at hourly intervals such that a respective one of the day hour numbers is visible in the day hours window for one hour each during the hours of the day, and a night hours disc provided with twelve hour numbers and adapted to be rotationally advanced at hourly intervals such that a respective one of the night hour numbers is visible in the night hours window for one hour each during the hours of the night, wherein the two hour discs are at the most partly overlapping and the two hour display windows and the two hour discs are arranged such that the hour numbers of the day hours disc are visible only in the day hours display window and the hour numbers of the night hours disc are visible only in the night hours display window.

By using two separate hour discs and two separate hour display windows for the day hours display and the night hours display, respectively, there are possible on the one hand larger hour number representations than in case of one single hour display window and one single 24-hour disc. On the other hand, by using two separate hour discs and two separate hour display windows, it is sufficient to have the hour numbers 1 to 12 for each hour disc. Thus, a maximum of three two-digit numbers has to be accommodated for each hour disc, which may be reduced further to two two-digit numbers if the number 10 is written as Roman numeral X. And these two-digit numbers all have as first number a 1, which requires considerably less space for representation than the number 2. The hour numbers 20 to 24 beginning with the number 2 and taking up especially much space are not required.

In addition to the completely new optical appearance on the watch dial, the use of two hour display windows provides for an advantage in reading the hour numbers. If one single hour display window and one single hour disc were used, the hour disc would have to accommodate, in addition to nine one-digit numbers, fifteen two-digit numbers. The one-digit, and thus better readable, hour numbers are unfortunately during the hours of the night, i.e. a period in which one is usually asleep. As of 10 o'clock in the morning, the double-digit numbers begin, ending at midnight only. A display device for watches according to the invention, comprising two hour display windows and two hour discs, has a total of six double numbers during 24 hours only, which may be reduced further to only four double-digit hour numbers, namely two times 11 and two times 12, if the number 10 is indicated as Roman numeral X.

Preferably, the alternation between hour display using the day hours disc and hour display using the night hours disc take place at 8 o'clock a.m. and 8 o'clock p.m., but may also take place, for example, at 6 o'clock a.m. and 6 o'clock p.m.

The readability of the hour display is improved still further in an embodiment of the invention in which each one of the two hour discs is provided with a free portion having no hour numbers, with the free portion of the day hours disc being visible in the day hours display window during the hours of the night and the free portion of the night hours disc being visible in the night hours display window during the hours of the day.

The two hour discs may each be constituted by a circular disc, i.e. a circle covering the full area, or by an annular disc. It is also possible to form one of the two hour discs as a circular disc and the other hour disc as an annular disc.

In an embodiment of the invention, the hour discs have disc axes that are mutually spaced apart such that the hour discs do not overlap. In another embodiment of the invention, the hour discs have disc axes that are mutually spaced apart such that the hour discs are partly overlapping.

In an embodiment of the invention, the two hour discs are designed for geared drive, and for driving the two hour discs there is provided at least one driving device in the form of a driving gearwheel having thirteen teeth, twelve teeth thereof being provided for feeding, at hourly, intervals, the respective hour number of the respective hour disc, and the thirteenth tooth being provided for feeding the free portion of the respective hour disc to the visible range of the associated hour display window.

In an embodiment of the invention, there is arranged at least one minute display device and/or second display device externally of the two hour display windows.

In a particularly preferred embodiment of the invention, the display device for watches is in the form of a display module which is adapted to be drivingly coupled to a watch work. Such a display module is manufactured in the form of a separate constructional unit and is attached to the watch work or a gearing module of the watch provided with an inventive display device, which is driven by the watch work and attached thereto, while the driving device for the two hour display discs is drivingly coupled, for example, to a drive shaft or a drive pinion of the watch work or gearing module, respectively. The watch work may be a fully mechanical watch work or an electromotive watch work.

In an embodiment of the invention, the display module is designed such that the two hour display windows are at the 10 o'clock and 2 o'clock positions. By rotating the display module by 90°, the two hour display windows may also be arranged at the 7 o'clock and 11 o'clock positions. An off-center minute display may be provided for each of said hour display windows.

A display device according to the invention is suitable in particular for wristwatches and pocket watches.

BRIEF DESCRIPTION OF THE DRAWINGS

The invention will now be elucidated in more detail by way of embodiments shown in the drawings in which.

DETAILED DESCRIPTION OF THE INVENTION

FIGS. 1 to 7 illustrate embodiments of components of a wristwatch comprising a watch display device of the type according to the invention, which is designed as a display module and has two non-overlapping hour discs. Such a wristwatch comprises a watch case having three constructional units or modules arranged one above the other: the lowermost is a watch work module, having a gearing module arranged thereabove, over which a display module according to the invention is arranged; a watch dial or face may be designed as part of the display module or as an attached, separate component. The watch work comprises a fully mechanical watch work having a moving spring and a balance or an electromotive watch work having a battery-operated electric stepper motor of conventional type. The gearing module comprises a gearing coupled to the driven shaft of the watch work module and converting the rotation of the driven shaft into different rotational movements, as required on the one hand for displaying minutes and on the other hand for displaying hours. The display module takes care of these two rotational movements for driving a minute display and driving the two hour discs, respectively.

Figure 1:
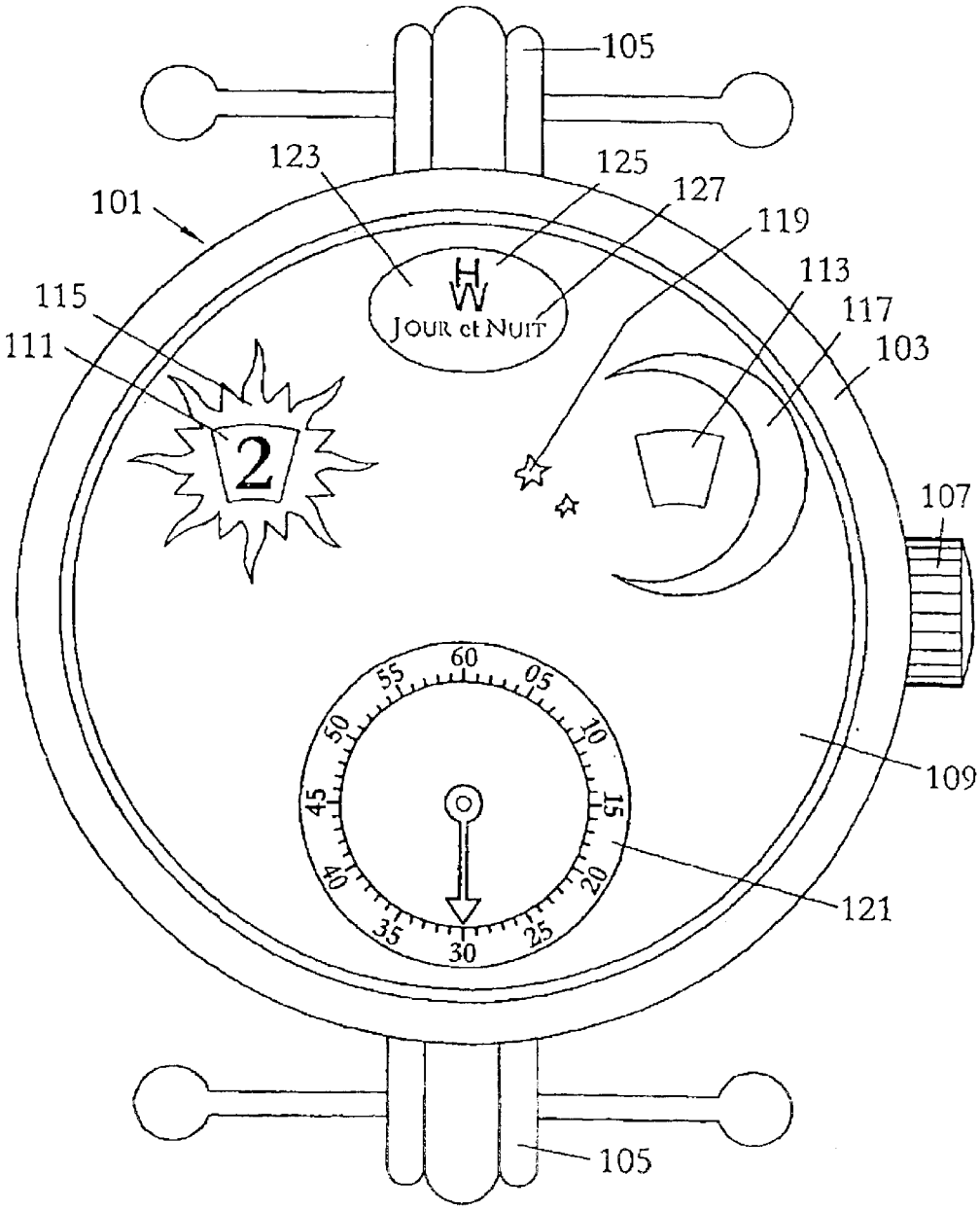
FIG. 1 shows a plan view of a wristwatch designed according to the invention during display of the hours of the day.
Figure 2:
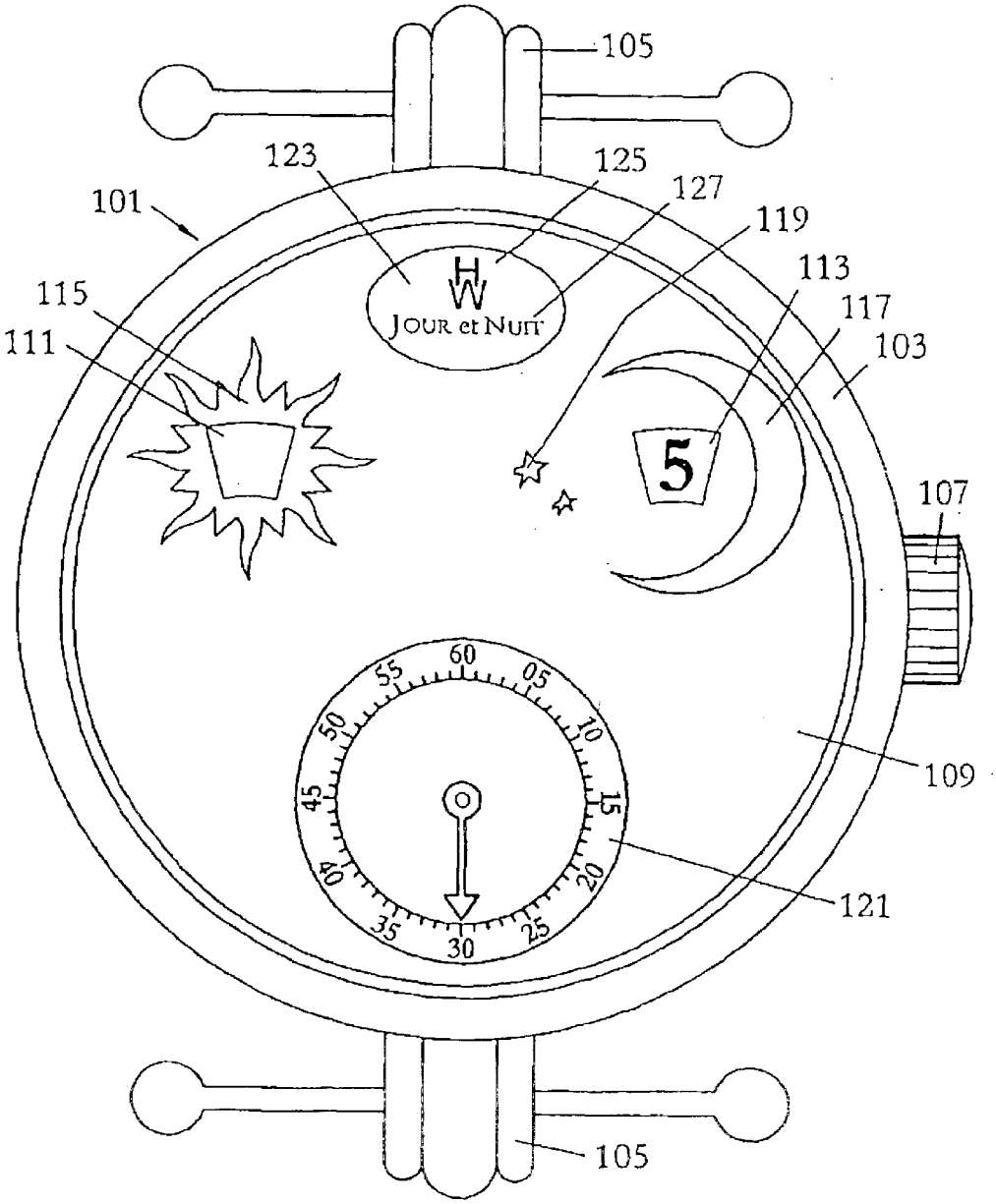
FIG. 2 shows a plan view of a wristwatch designed according to the invention during display of the hours of the night.

FIGS. 1 and 2 illustrate an embodiment of a wristwatch 101 having a display module according to the invention, each indicating a plan view of a watch dial, with FIG. 1 illustrating the watch during day hours display and FIG. 2 illustrating the watch during night hours display.

This wristwatch 101 comprises a watch case 103 having two diametrically opposed lugs 105 for attachment of a watch band, not shown. At the periphery of the watch case 103 there is provided a crown 107 allowing watch settings to be made and permitting winding of the driving spring in case of a completely mechanical watch work.

At angular positions which, in case of a watch having an hour hand, correspond to the hour numbers 10 and 2, a dial 109 of the wristwatch 101 is provided with a day hours display window 111 and a night hours display window 113, respectively. For pointing out which one of the two hour display windows displays the hours of the day and which one of the two hour display windows displays the hours of the night, the day hours display window 111 is surrounded by the representation of a sun 115, and the night hours display window is surrounded by the representation of a moon 117 and stars 119. At the angular positions which, in case of a watch with hour hand, would correspond to hour numbers 6 and 12, there are arranged a minute display 121 and a figurative field 123, respectively, the latter showing a mark 125 and a watch designation 127, for example "Jour et Nuit," as a hint towards different day and night hours display.

During the display of the hours of the day, as illustrated in FIG. 1, the night hours display window 113 is closed, whereas during the display of the hours of the night, as illustrated in FIG. 2, the day hours display window 111 is closed.

Figure 3:
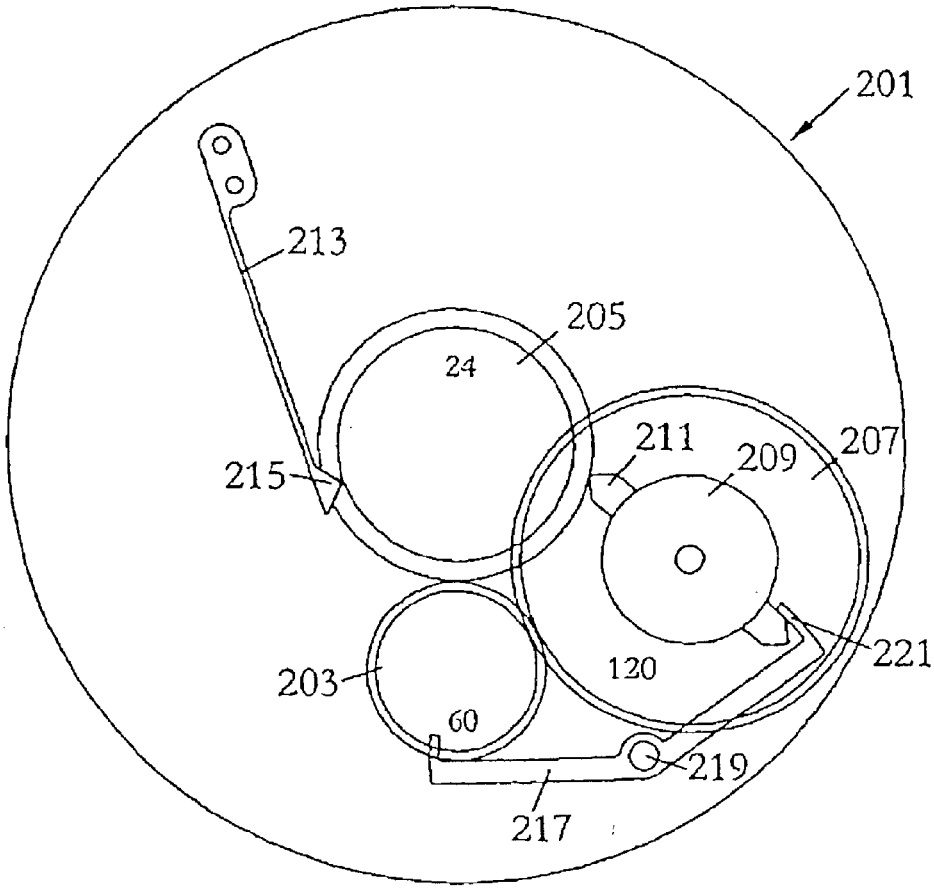
FIG. 3 shows a schematic plan view of a gearing module adapted to be used together with a display module designed according to the invention.

FIG. 3 illustrates a schematic plan view of an embodiment of a known per se gearing module 201 which, in an assembled watch, is applied to a watch work module (not shown in the drawings) and is drivingly coupled thereto. The gearing module 201 comprises a minute gearwheel 203, an hour gearwheel 205 and a transmission gearwheel 207 meshing with the minute gearwheel 203. The teeth of the three gearwheels 203, 205 and 207 are not shown individually but are indicated by a circumferential circle each. The number of the teeth of each of the gearwheels is indicated by a number written into the respective gearwheel. Accordingly, in the embodiment illustrated, the minute gearwheel 203 has 60 teeth, the hour gearwheel 205 has 24 teeth and the outer toothed rim of the transmission gearwheel 207 meshing with the teeth of the minute wheel 203 has 120 teeth. Above the transmission gearwheel 207 and concentric therewith, there is arranged an indexing wheel 209 meshing with the hour gearwheel 205 and having two diametrically opposed indexing teeth 211 which, upon rotation of the indexing wheel 205, establish driving engagement with the hour gearwheel 205.

The hour gearwheel 205 is retained in its respective rotational position by means of a pivotable locking finger 213 between the moments of time in which it is rotationally advanced by the teeth 211 of the indexing wheel 209. By means of a biasing spring, not shown, the locking finger 213 is biased towards the hour gearwheel 205 and has a locking tooth 215 cooperating with the teeth of the hour gearwheel 205.

The indexing wheel 209 has an energy storing spring (not shown) associated therewith which is biased by rotation of the transmission gearwheel 207 and rotationally advances the indexing wheel 209 upon relaxation thereof. Between the minute gearwheel 203 and the indexing wheel 209 there is provided a locking lever 217 which is pivotable around a pivot axis 210, biased towards the minute gearwheel 203 by means of a biasing spring, not shown, and has one end abutting a control cam (not shown) arranged on the minute gearwheel 203 and having a control projection, with the other end having a locking stop 221. The locking stop 221 is in locking engagement with one of the two indexing teeth during the majority of a revolution of the minute gearwheel 205 and, during each revolution of the minute gearwheel 205, is briefly disengaged once from the indexing teeth 211 by means of the control projection of the control cam. At this time, the indexing wheel rotates by 180° driven by the energy storing spring, to such an extent until it is stopped against further movement by the locking lever 217 that has meanwhile pivoted back.

Figure 4:
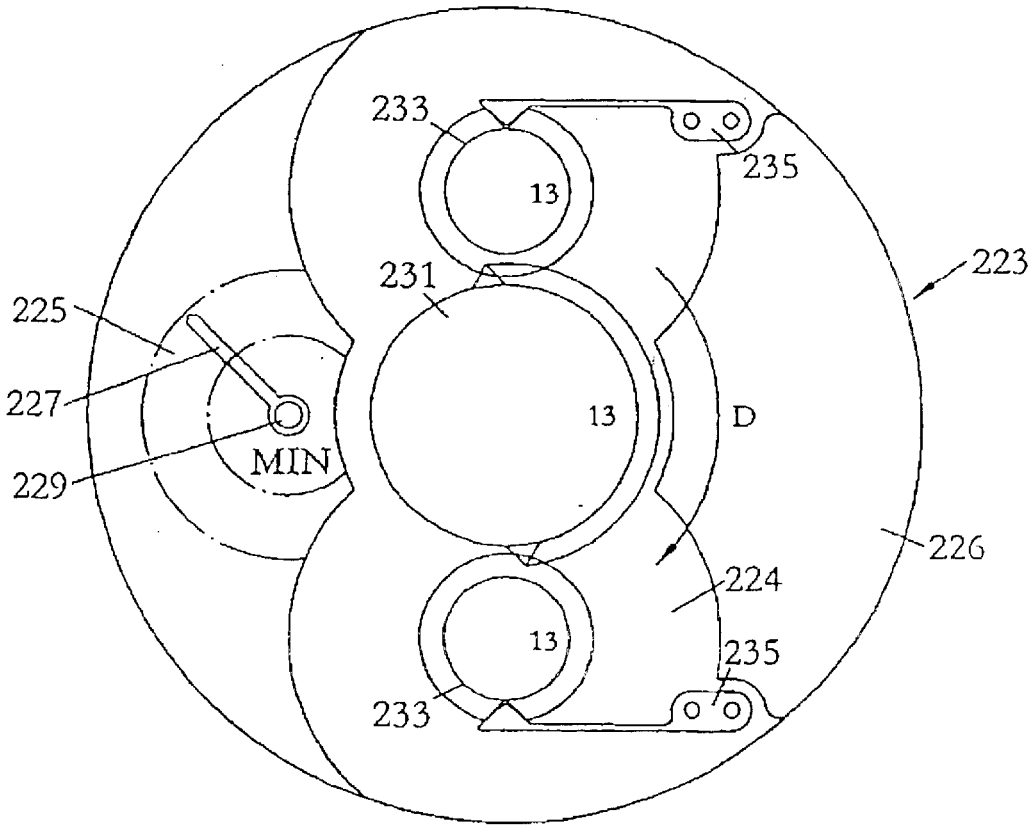
FIG. 4 shows a schematic plan view of a display module designed according to the invention, comprising non-overlapping hour discs, with the hour discs and the watch dial being removed.

FIG. 4 illustrates a schematic plan view of an embodiment of a display module 223 according to the invention, without hour discs and dial. The position of an annular minute display graduation 225 on the dial, not shown, is indicated in broken lines. A minute hand 227 cooperating with the minute graduation 225 is placed on a minute hand shaft 229, with the minute hand 227 actually being connected to the minute hand shaft 229 only after attachment of the watch dial. The minute hand shaft 229 is drivingly connected to the minute gearwheel 203 of the gearing module 201 shown in FIG. 3, preferably by means of a drive shaft (not shown) arranged in the center of the minute gearwheel 203. For coupling the minute hand shaft 229 with the latter drive shaft, the display module 223 is to be brought into a position rotated counterclockwise by 90° with respect to the representation in FIG. 4.

In the center of the display module, there is provided a coupling gearwheel 231 which is drivingly connected to the hour gearwheel 205 of the gearing module 201 and is provided with teeth over part of its circumference only, to be precise with 13 teeth. The direction of rotation of the coupling gearwheel 231 is indicated by an arrow D. On each one of diametrically opposite sides of the coupling gearwheel 231, there is provided a hour disc gearwheel 233 each having 13 teeth. Each of the two hour disc gearwheels 223 has a locking pawl 235 associated therewith which is biased towards the respective hour disc gearwheel and by means of which the respectively associated hour disc gearwheel 233 is retained in its respective rotational position reached after a particular rotational step.

The gearwheels 231 and 233 are arranged in a recess 224 in a casing surface 226 of the display module 223.

The coupling gearwheel 231 is provided with teeth over half of its circumference only, as it is supposed to alternatingly drive only the one or the other one of the two hour disc gearwheels 223, depending whether hours of the day are to be displayed by way of the day hours disc or hours of the night are to be displayed by way of the night hours disc at the particular moment. This means that the teeth of the coupling gearwheel 231 at all times are engaged with only one of the two hour disc gearwheels 223.

The coupling gearwheel 231 has 13 teeth since each hour disc has 13 display positions: 12 display positions for one of 12 hour numbers each and a display position designed as free area and appearing in the associated hour display window when the respective other hour disc displays hours.

Figure 5:
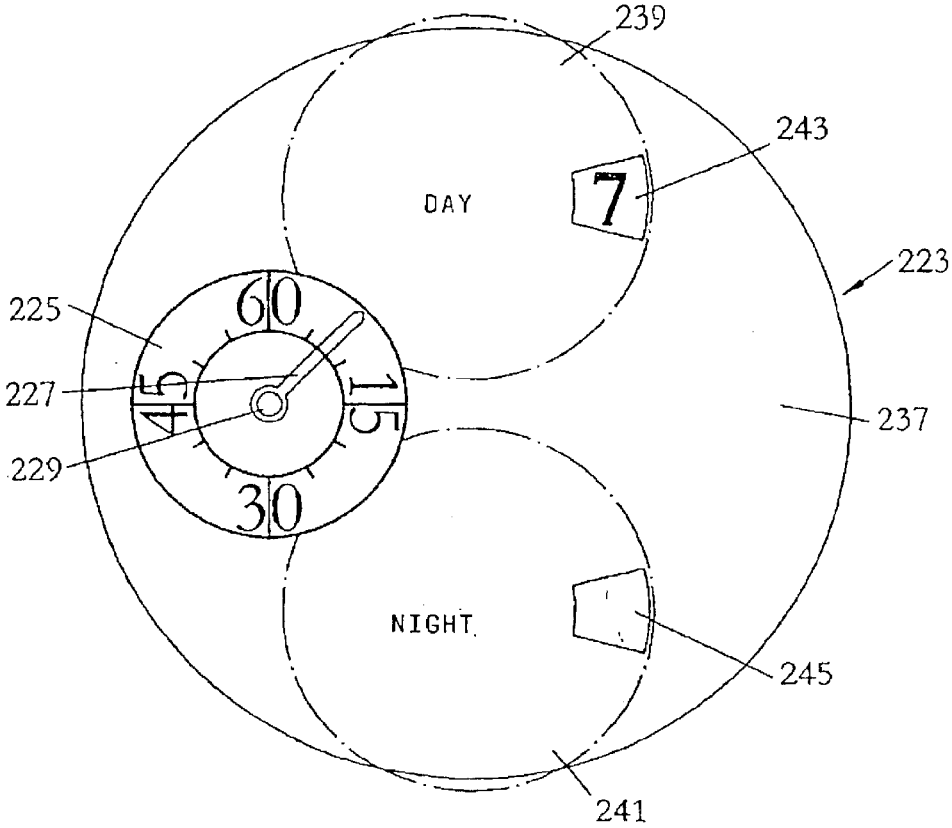
FIG. 5 shows a schematic plan view of a display module designed according to the invention, illustrating the hour discs and the watch dial in an embodiment with non-overlapping hour discs in a first position of the hour display windows and the hour discs.
Figure 6:
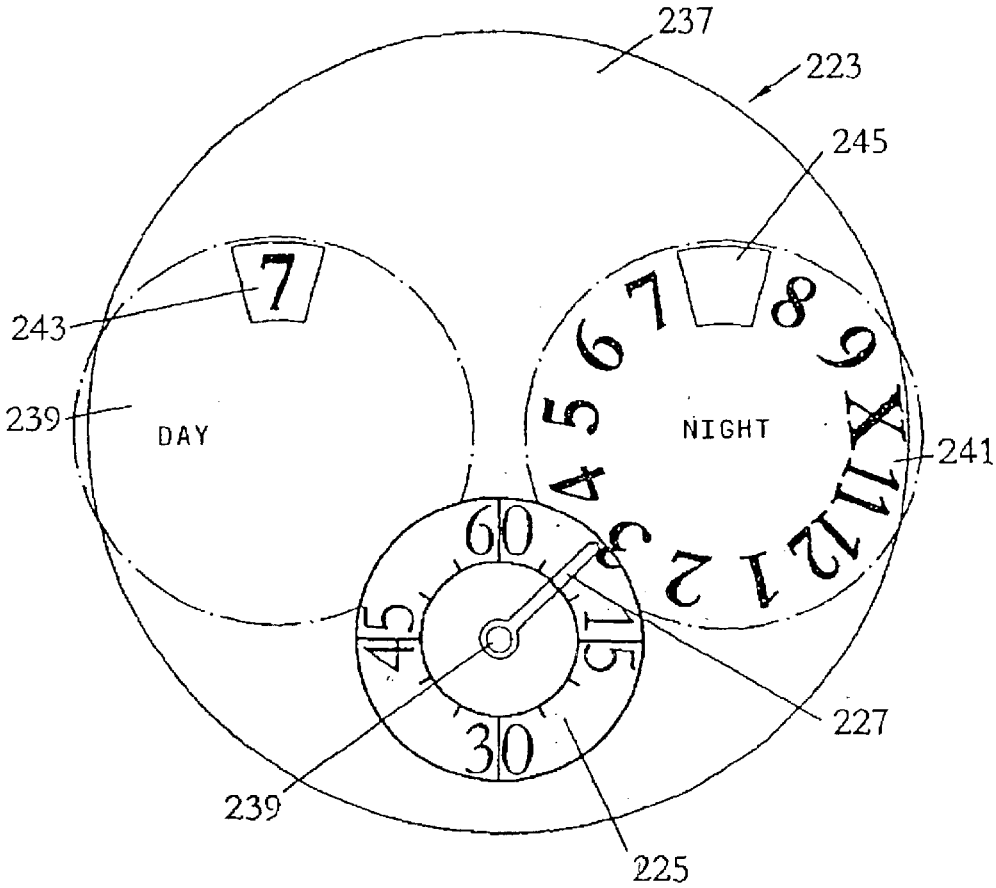
FIG. 6 shows the display module illustrated in FIG. 5 in a second position of the hour display windows and the hour discs.

FIGS. 5 and 6 each show a schematic plan view of an embodiment of a display module according to the invention, provided with hour discs and dial. Both embodiments merely differ by the different angular positions of the two hour discs, the two hour display windows and the minute display.

For the embodiment shown in FIG. 5, the gearing module 201 is to be arranged in watch case 103 rotated by 90° in clockwise direction as compared to the angular position shown in FIG. 3, so that the minute hand shaft 229 is suitably aligned with the minute gearwheel 203 or the drive shaft arranged in the center thereof.

The display module 223 shown in FIG. 5 comprises a watch dial 237 having arranged thereon the minute display graduation 225 cooperating with the minute hand 227 located above the dial 237. Underneath the dial 237, there are provided a day hours disc 239 and a night hours disc 241 which are each drivingly coupled to one of the two hour disc gearwheels 233 shown in FIG. 4. The day hours disc 239 has a day hours display window 243 associated therewith, whereas the night hours disc 241 has a night hours display window 245 associated therewith.

In the embodiment shown in FIG. 5, the two hour discs 239 and 241 are in those angular positions of the dial 237 which, in case of a watch with an hour hand, would correspond to the hour positions of 12 o'clock and 6 o'clock. In the embodiment shown in FIG. 6, the two hour discs 239 and 241 are in the hour positions of 9 o'clock and 3 o'clock, respectively. In the embodiment shown in FIG. 5, the minute display is in the hour position of 9 o'clock, whereas it is in the hour position of 6 o'clock in the embodiment according to FIG. 6.

Figure 7:
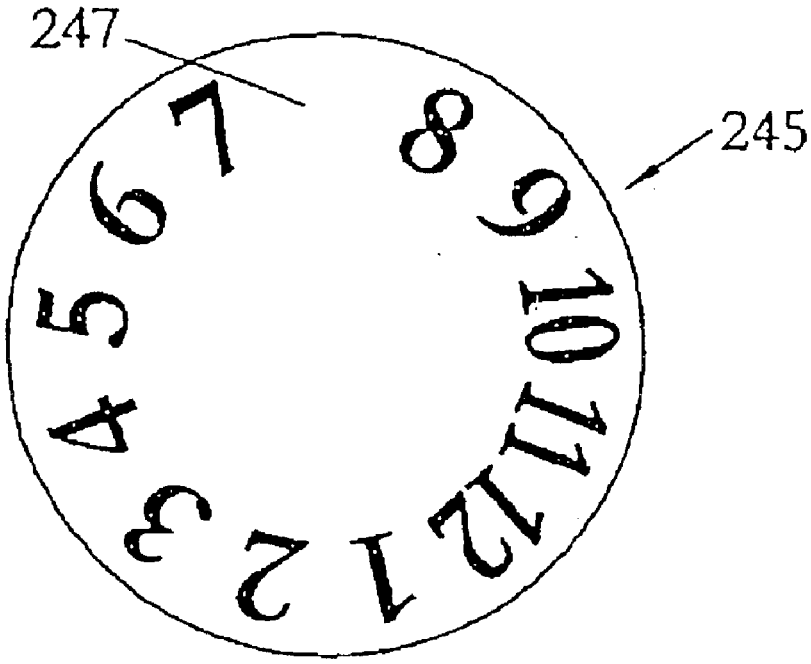
FIG. 7 shows a schematic plan view of an hour disc of a display module designed according to the invention.
Figure 8:
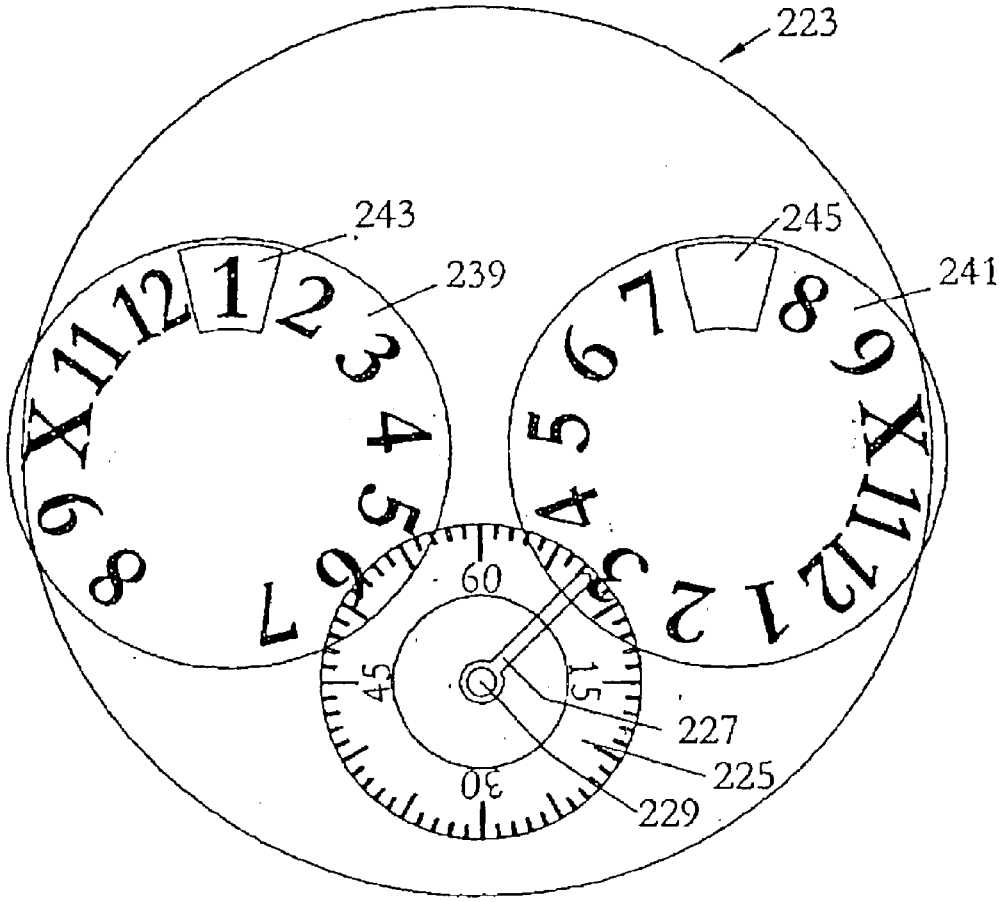
FIGS. 8 and 9 show the display module according to FIG. 6, i.e. with non-overlapping hour discs, in which the hour discs are shown in fully visible form during day hours display and night hours display, respectively.
Figure 9:
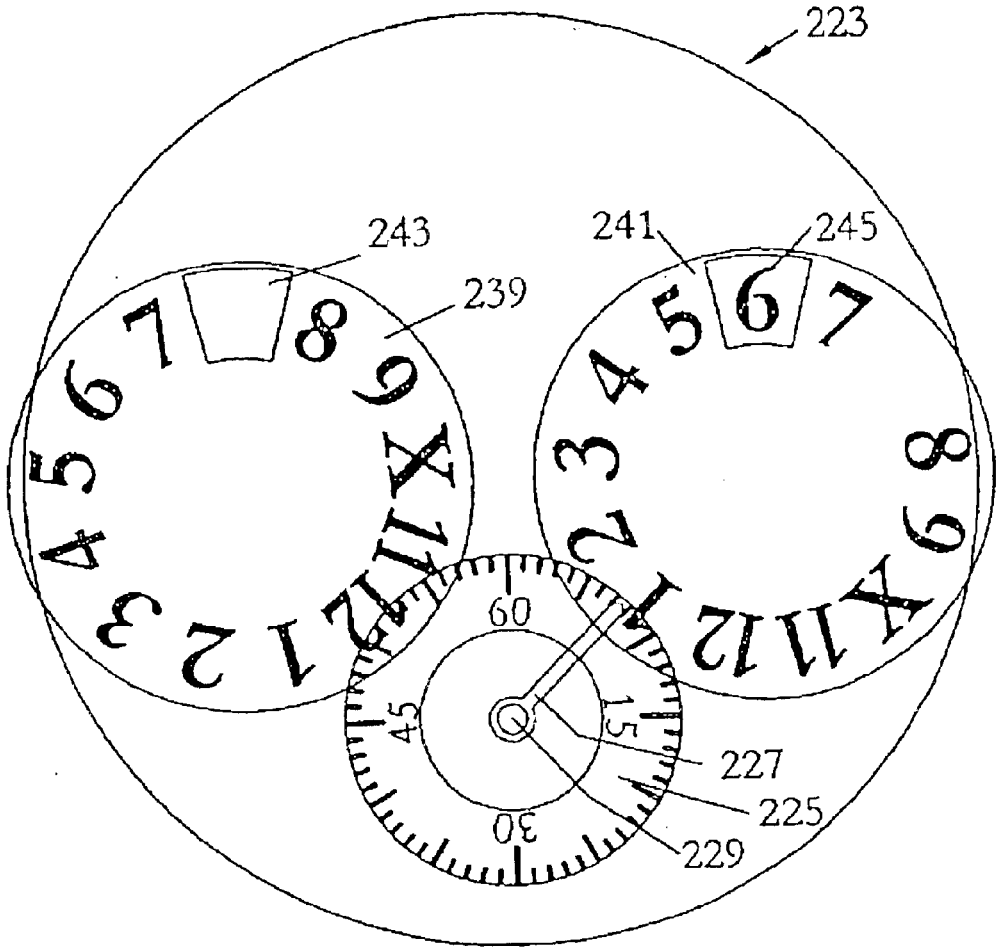
Figure 10:
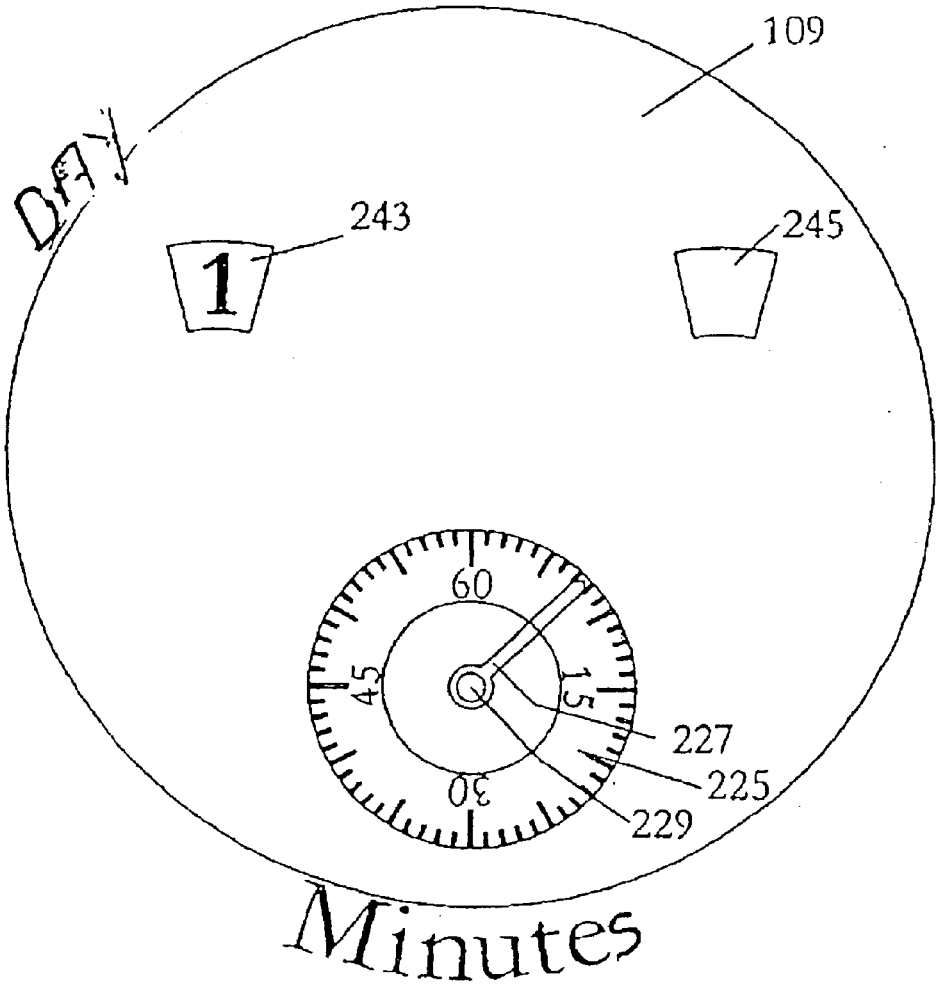
FIGS. 10 and 11 show the display module illustrated in FIGS. 8 and 9 without the complete hour discs being made visible.
Figure 11:
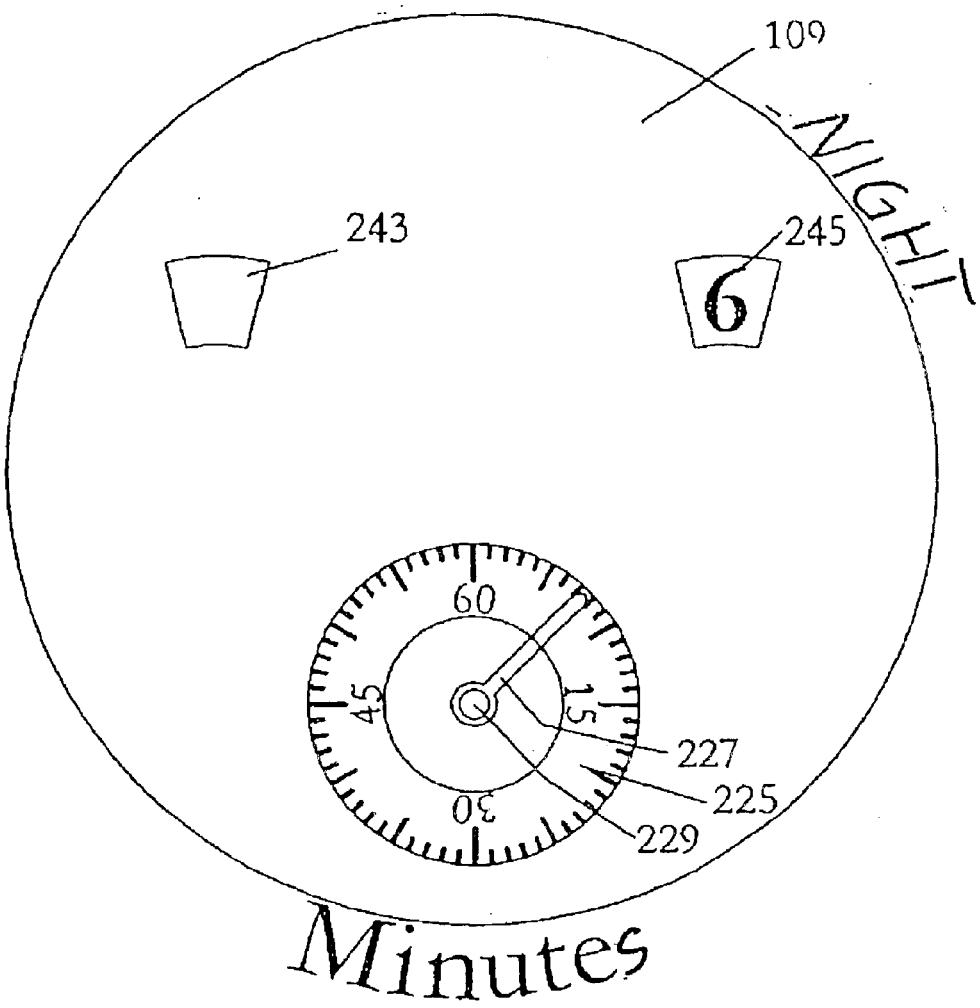
Figure 12:
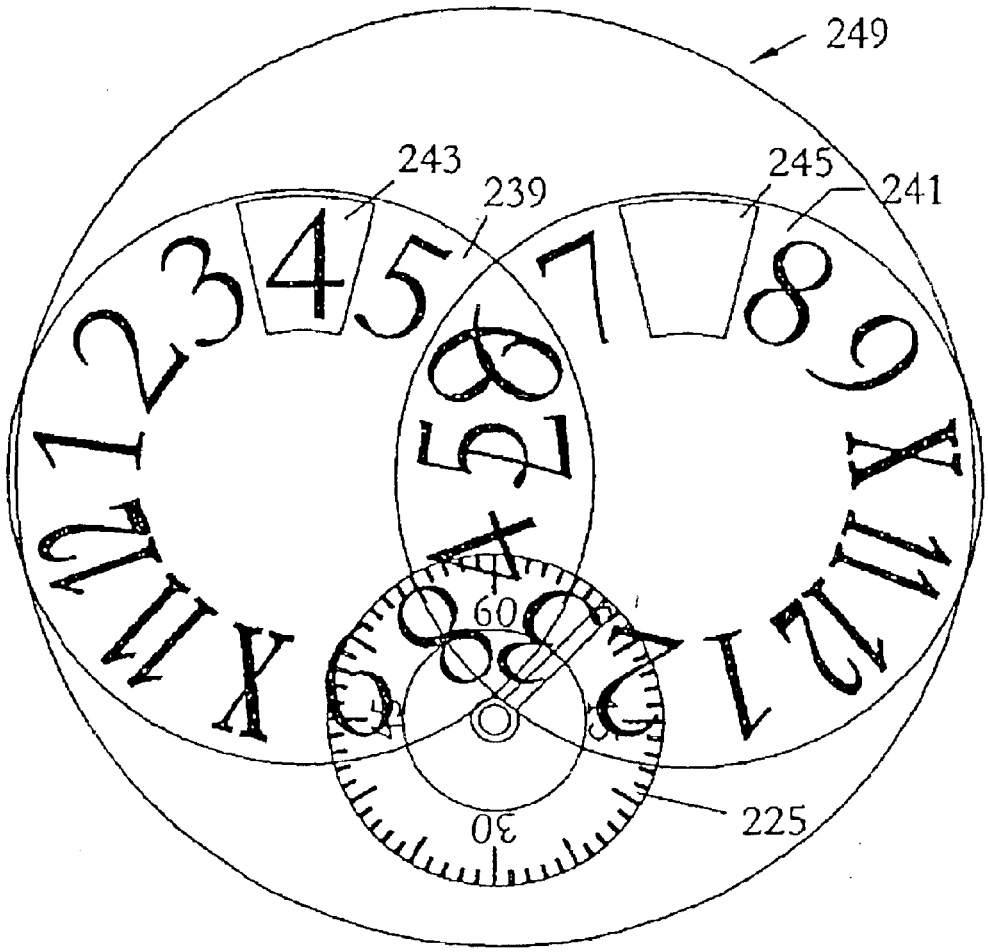
FIGS. 12 to 15 show representations corresponding to FIGS. 8 to 11, but for an embodiment with partly overlapping hour discs.
Figure 13:
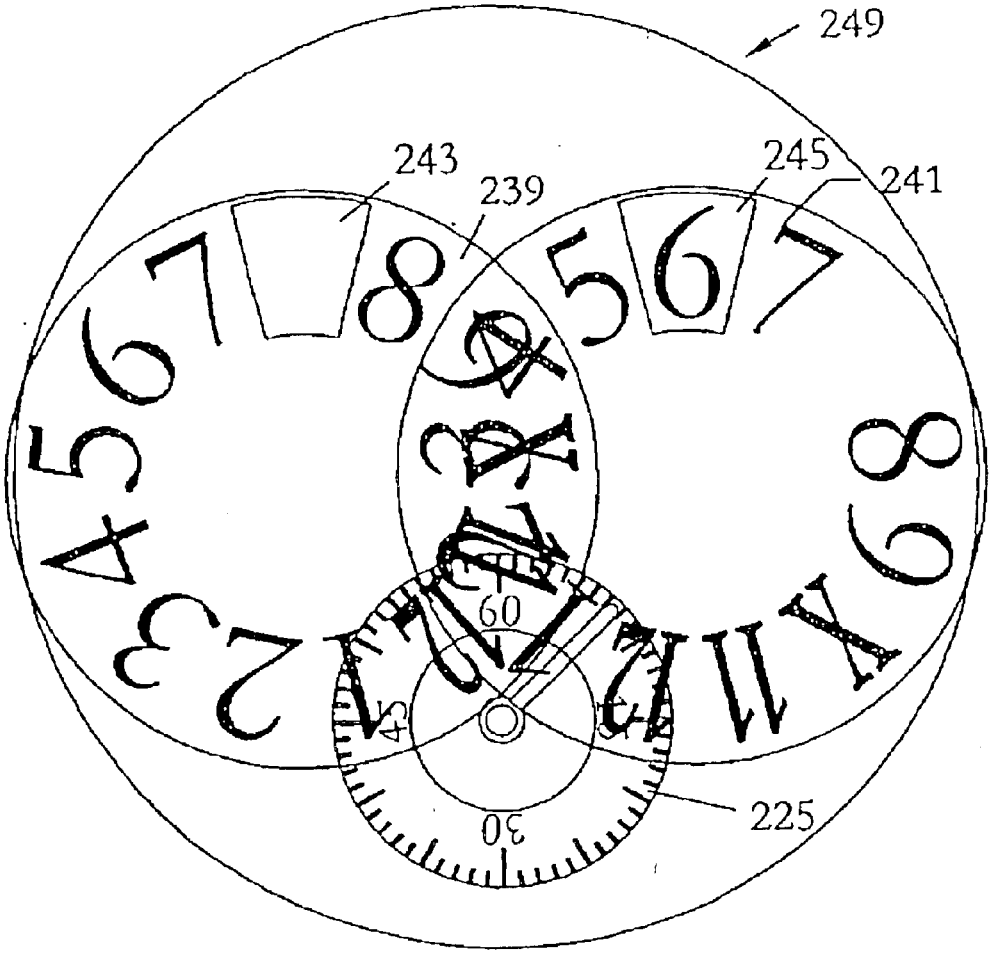
Figure 14:
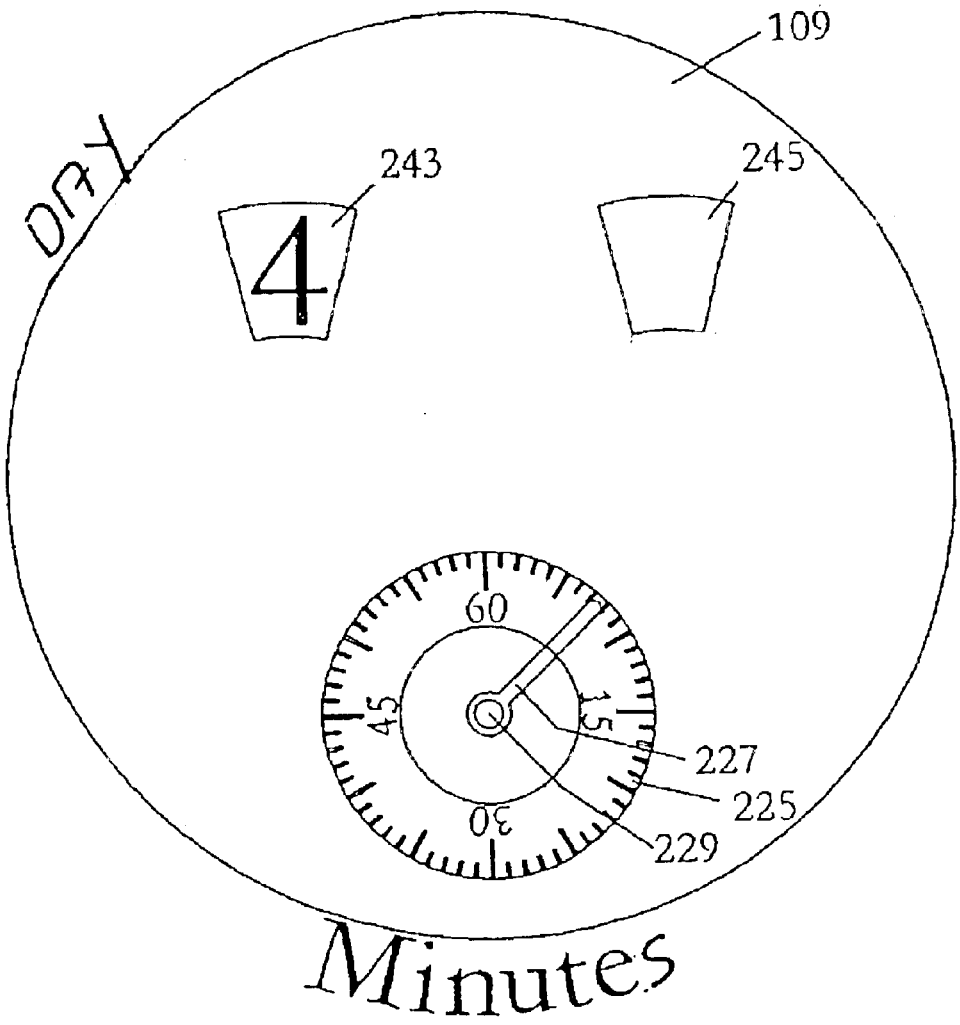
Figure 15:
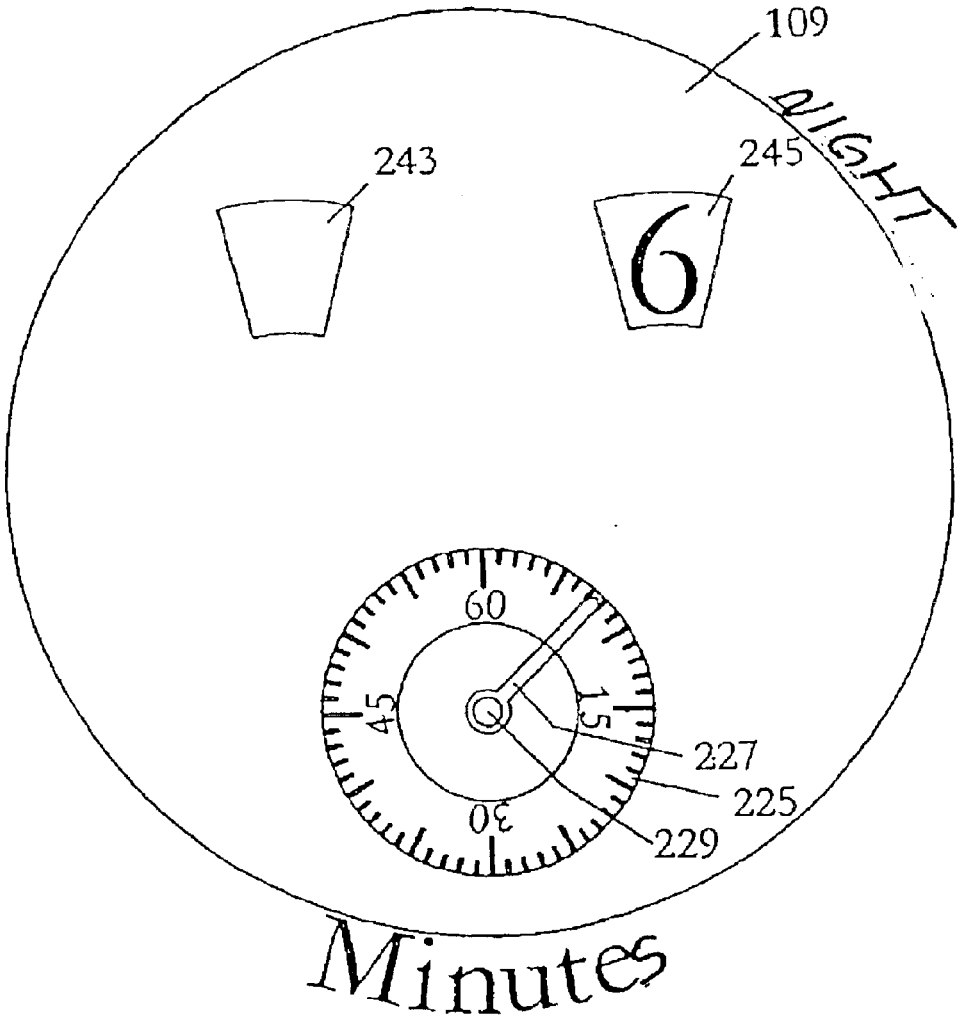

An hour disc 241 suitable for the embodiment according to FIG. 6 is shown in FIG. 7 in a plan view. The hour disc 245 carries the hour numbers 1 to 12 listed in equally spaced apart form all around the circumference thereof, with a free area 247 being left between the hour numbers 7 and 8, which is located in the related hour display window when the current hours are displayed by the other hour disc.

An hour disc suitable for the embodiment according to FIG. 5 differs from the hour disc 241 shown in FIG. 7 in that the individual hour numbers are not arranged in radially standing manner, but lying perpendicularly to the radial direction.

FIGS. 8 to 11 illustrate the embodiment of a display module 223 according to FIG. 6 with non-overlapping hour discs 239, 241, and FIGS. 12 to 15 illustrate an embodiment of a display module 249 with partly overlapping hour discs 239, 241. For reasons of clarity, FIGS. 8, 9, 12 and 13 illustrate the hour discs 239, 241 as if they were completely visible, whereas FIGS. 10, 11, 14 and 15, in correspondence with reality, show only the part that is visible in the respective hour display window of dial 237. FIGS. 8, 10, 12 and 14 indicate the state during day hour display, whereas FIGS. 9, 11, 13 and 15 indicate the state during night hour display. As can be seen from a comparison of FIGS. 8 to 15, larger representations of the hour numbers can be obtained in case of overlapping hour discs, however, at the expense of a larger axial constructional height of the watch since the two hour discs 239, 241 have to be arranged in axially spaced apart manner, whereas the non-overlapping hour discs 239, 242 may be arranged in the same axial plane of the watch.

Finally, the mode of operation of a watch designed according to the invention is to be elucidated briefly in addition.

The driving force of the watch work is introduced to the shaft of the minute wheel 203 of the gearing module 201. From there, the driving force is transmitted to the minute gearwheel 203 which in turn drives the transmission gearwheel 207. The energy storing spring arranged on the transmission gearwheel 207 stores the driving force for one hour. Thereafter, the locking lever 217 is released in accordance with the control cam associated with the minute gearwheel 203, allowing the indexing wheel 209 to rotate by 180°, whereby the hour gearwheel 205 is advanced by one hour position, in which it is then retained for one hour by means of the locking pawl 213. As a consequence of this rotational movement of the hour gearwheel 205, the coupling gearwheel 231 of the display module 223 is rotationally advanced by one hour position, causing a corresponding rotational advance of the day hours disc 239 or the night hours disc 241. The coupling gearwheel 231 moves the respective hour disc 239 or 241 performing the hour display in relation to the associated hour display window 243 or 245, at hourly intervals by way of twelve of its teeth from hour number to hour number, and then brings the free area 247 of this hour disc 239 or 241 into the associated hour display window 243 or 245, by way of the thirteenth tooth. The teeth of the coupling gearwheel 231 then are disengaged from the teeth of the hour disc gearwheel 233 or this hour disc 239 or 241, and are engaged with the teeth of the hour disc gearwheel 233 of the respective other hour disc 241 or 239.

What is claimed is:

1. A display device for watches, comprising:

a watch dial provided with a day hours display window for displaying a respective one of the hours of the day during daytime and with a separate night hours display window for displaying a respective one of the hours of the night during nighttime, a day hours disc provided with twelve hour numbers and adapted to be rotationally advanced at hourly intervals such that a respective one of the day hour numbers is visible in the day hours window for one hour each during the hours of the day, and a night hours disc provided with twelve hour numbers and adapted to be rotationally advanced at hourly intervals such that a respective one of the night hour numbers is visible in the night hours window for one hour each during the hours of the night, wherein the two hour discs are at most partly overlapping, and the two hour display windows and the two hour discs are arranged such that the hour numbers of the day hours disc are visible only in the day hours display window and the hour numbers of the night hours disc are visible only in the night hours display window.

2. A display device for watches according to claim 1, wherein each one of the two hour discs has a free portion not provided with hour numbers, with the free portion of the day hours disc being visible in the day hours display window during the hours of the night and the free portion of the night hours disc being visible in the night hours display window during the hours of the day.

3. A display device for watches according to claim 1, wherein at least one of the two hour discs is constituted by a full-area circular disc.

4. A display device for watches according to claim 1, wherein at least one of the two hour discs is constituted by an annular disc.

5. A display device for watches according to claim 1, wherein the two hour discs have disc axes that are mutually spaced apart such that the hour discs are not overlapping.

6. A display device for watches according to claim 1, wherein the two hour discs have disc axes that are mutually spaced apart such that the hour discs are partly overlapping.

7. A display device for watches according to claim 1, wherein the two hour discs are designed for geared drive and for driving the two hour discs, there is provided at least one driving gearwheel having thirteen teeth, twelve thereof being provided for feeding the respective hour number at hourly intervals and the thirteenth tooth being provided for feeding the respective free portion to the visible portion of the related hour display window.

8. A display device for watches according to claim 1, wherein at least one minute display device and/or a second display device are arranged externally of the two hour display windows.

9. A display device for watches according to claim 1, which is designed as a display module adapted to be drivingly coupled to a gearing module.

10. A wristwatch comprising a display device according to claim 1.

11. A pocket watch comprising a display device according to claim 1.

* * * * *